US009068394B1

(12) United States Patent
Geiselman, III

(10) Patent No.: US 9,068,394 B1
(45) Date of Patent: Jun. 30, 2015

(54) SPACE SAVING LADDER

(71) Applicant: Grover J. Geiselman, III, Richmond, TX (US)

(72) Inventor: Grover J. Geiselman, III, Richmond, TX (US)

( * ) Notice: Subject to any disclaimer, the term of this patent is extended or adjusted under 35 U.S.C. 154(b) by 0 days.

(21) Appl. No.: 14/512,201

(22) Filed: Oct. 10, 2014

(51) Int. Cl.
*E06C 7/08* (2006.01)
*E06C 1/383* (2006.01)
*E06C 9/08* (2006.01)

(52) U.S. Cl.
CPC ..... *E06C 7/082* (2013.01); *E06C 1/383* (2013.01); *E06C 9/085* (2013.01)

(58) Field of Classification Search
CPC ..... E06C 1/383; E06C 9/085
See application file for complete search history.

(56) References Cited

U.S. PATENT DOCUMENTS

| | | | | | |
|---|---|---|---|---|---|
| 292,150 | A | * | 1/1884 | Work | 182/159 |
| 314,899 | A | | 3/1885 | Wilson | |
| 382,114 | A | | 5/1888 | Sherman | |
| 581,348 | A | | 4/1897 | Hunt | |
| 2,347,065 | A | | 4/1944 | Rigby | |
| 2,368,915 | A | | 2/1945 | Brandel | |
| 2,580,045 | A | | 12/1951 | Reed | |
| 2,650,014 | A | | 8/1953 | Harrison | |
| 2,875,935 | A | * | 3/1959 | Buttermore et al. | 182/160 |
| 2,922,487 | A | | 1/1960 | Reitknecht | |
| 2,992,696 | A | | 7/1961 | Jedinak | |
| 3,005,513 | A | | 10/1961 | Larson | |
| 3,043,397 | A | | 7/1962 | Tillotson | |
| 3,057,432 | A | | 10/1962 | Harrison | |
| 3,414,081 | A | | 12/1968 | Wedvik | |
| 3,446,311 | A | | 5/1969 | Alfie | |
| 3,556,248 | A | | 1/1971 | Brown | |
| 3,575,263 | A | | 4/1971 | Reinhard | |
| 3,722,622 | A | | 3/1973 | Lauring | |
| 3,756,347 | A | | 9/1973 | Messera et al. | |
| 4,463,829 | A | * | 8/1984 | Grin | 182/160 |
| 4,678,060 | A | | 7/1987 | Pugliese | |
| 4,796,727 | A | | 1/1989 | Eaton | |
| 4,815,564 | A | * | 3/1989 | Yoo | 182/160 |
| 4,998,982 | A | | 3/1991 | Arnold et al. | |
| 5,195,610 | A | | 3/1993 | Chang | |
| 6,129,179 | A | | 10/2000 | Rooney et al. | |
| 6,145,621 | A | | 11/2000 | Nye | |
| 6,328,330 | B1 | | 12/2001 | Haaser | |
| 6,457,559 | B1 | | 10/2002 | Schluter et al. | |
| 6,536,558 | B2 | | 3/2003 | Price | |
| 6,715,584 | B2 | | 4/2004 | Ostyn | |
| 6,769,515 | B2 | | 8/2004 | Hillebrecht et al. | |
| 6,802,393 | B2 | | 10/2004 | Zheng | |
| 6,866,119 | B2 | | 3/2005 | Zheng | |
| 6,874,598 | B1 | | 4/2005 | Baker | |
| 7,051,837 | B1 | | 5/2006 | Brahier | |
| 8,191,685 | B1 | | 6/2012 | Geiselman, III | |

(Continued)

FOREIGN PATENT DOCUMENTS

| | | |
|---|---|---|
| GB | 2267111 | 11/1993 |

*Primary Examiner* — Alvin Chin-Shue
(74) *Attorney, Agent, or Firm* — Buskop Law Group, PC; Wendy Buskop

(57) ABSTRACT

A space saving ladder, wherein the ladder can be folded up into a compact unit for storage. In the open load bearing orientation, the space saving ladder is load bearing and conforms to requirements for free standing ladders. In the closed orientation, the space saving ladder can have steps or rungs, which can hinge upward as the ladder legs are moved closer to one another. In the closed orientation, the legs of the space saving ladder are adjacent to one another and the steps or rungs are enclosed in the ladder legs.

17 Claims, 7 Drawing Sheets

(56) References Cited

U.S. PATENT DOCUMENTS

| | | | |
|---|---|---|---|
| 2002/0112920 | A1 | 8/2002 | Price |
| 2003/0234140 | A1 | 12/2003 | Zheng |
| 2004/0020714 | A1 | 2/2004 | Ostyn |
| 2006/0032708 | A1 | 2/2006 | Welsh |
| 2009/0229918 | A1 | 9/2009 | Moss et al. |
| 2012/0012423 | A1 | 1/2012 | Murphy |

* cited by examiner

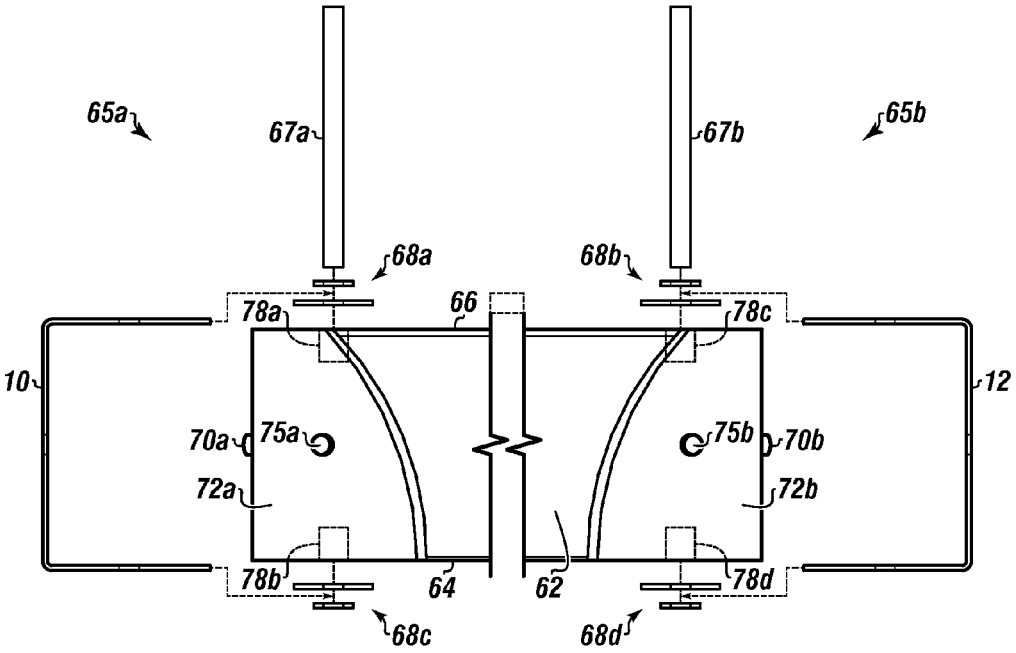
FIGURE 4A
FIGURE 4B
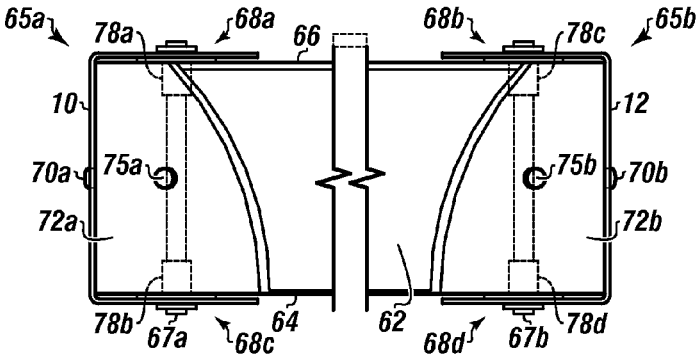

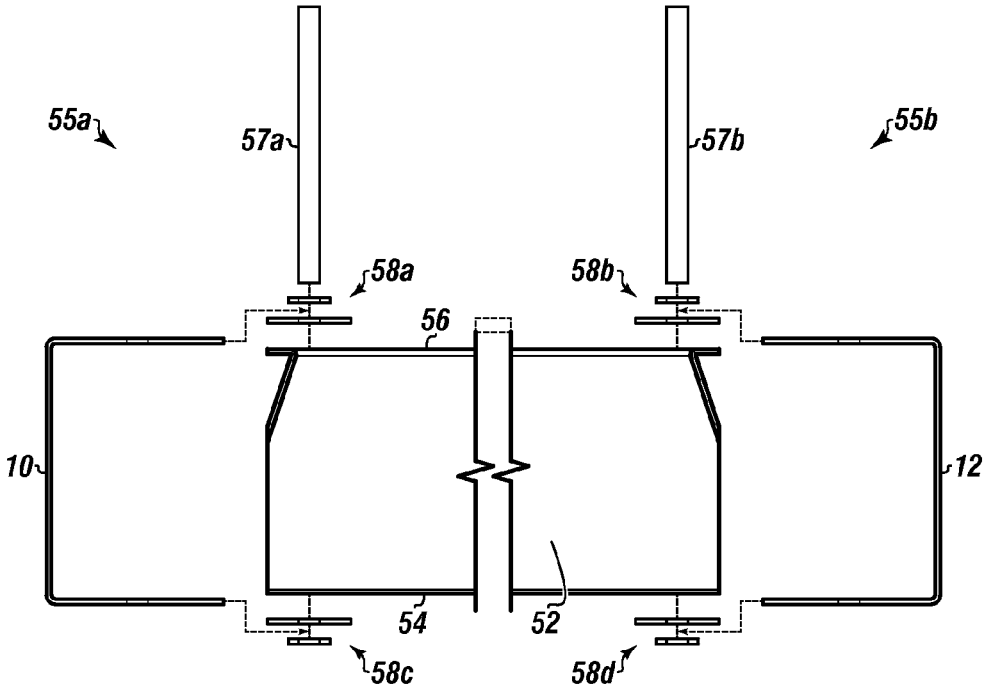
FIGURE 6A
FIGURE 6B
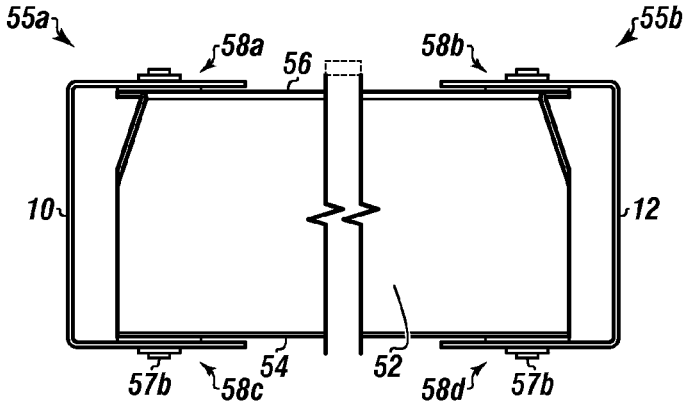

SPACE SAVING LADDER

FIELD

The present embodiments generally relate to folding ladders or space saving ladders, more particularly to ladders that can be folded up into a compact unit for storage.

BACKGROUND

Because of the long, slender nature of the ordinary ladder, it is often difficult to store when not in use. Various attempts have been made to provide a ladder which will fold up in some manner into a compact unit which can be stored easily. In many of these structures, all or some of the steps are detachable from the side rails to permit the particular folding action. The resulting loose pieces are often subject to loss while being stored.

Other previous folding ladders have proposed forming the ladder in numerous sections hinged together so they can be folded up something like the bellows of an accordion. While the accordion-folding construction is an improvement over other folding ladders, the design still leaves much to be desired, particularly in connection with modern light metal alloy ladders made of aluminum alloys and the like.

A need exists for a folding ladder that can be folded up into a compact unit for storage.

The present embodiments meet these needs.

BRIEF DESCRIPTION OF THE DRAWINGS

The detailed description will be better understood in conjunction with the accompanying drawings as follows:

FIG. 4A depicts an exploded view of the locking hinges according to one or more embodiments.

FIG. 4B depicts a completed view of the locking hinges according to one or more embodiments.

FIG. 6A depicts an exploded view of the pivoting hinges according to one or more embodiments.

FIG. 6B depicts a completed view of the pivoting hinges according to one or more embodiments.

Figure 1A:
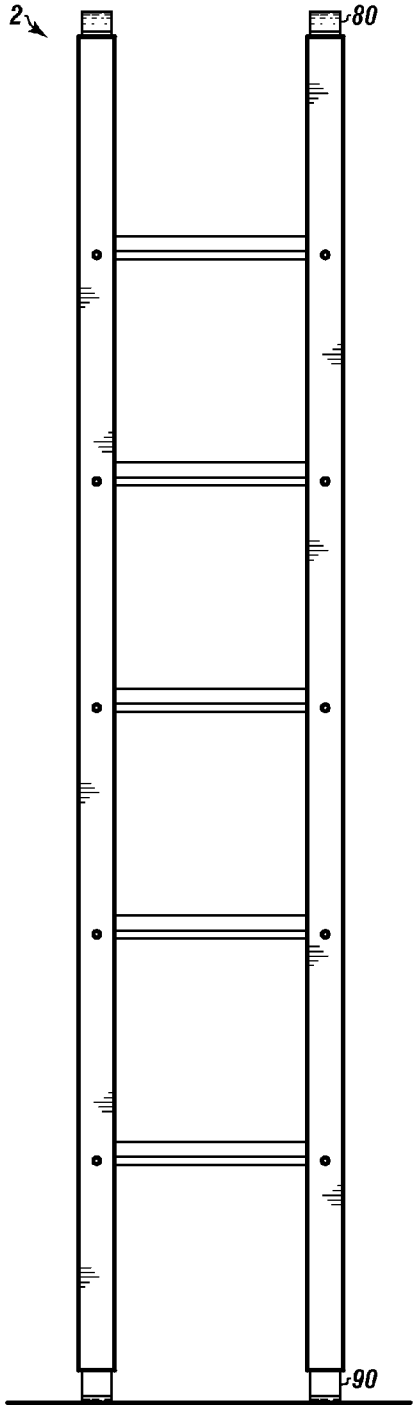
FIG. 1A is a front view of a space saving ladder according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relate to a space saving ladder that hinges from a load bearing ladder in an open load bearing orientation to a closed orientation. In the open orientation, the ladder is load bearing and conforms to OSHA requirements for free standing ladders. In the closed orientation, the ladder steps or rungs hinge upward as the ladder legs move closer to one another. In the closed orientation, the ladder steps or rungs are enclosed in the ladder legs.

The embodied space saving ladders can have two legs. In embodiments, the legs can be channels, such as U-shaped members, which are parallel to one another.

The embodied space saving ladders can have one or more steps that connect to each of the legs. In the open load bearing orientation, the steps are perpendicular to the legs. The embodiments herein refer to steps; however, the steps can also be rungs or other step shapes that are commonly used in the industry.

At least one step can be a locking step. The locking step can be connected to the two legs by locking hinges. The locking hinges can be any type of hinge that includes a detent pin and can move the locking step from its open position (perpendicular to the legs) to its closed orientation (disposed within the legs). In embodiments, the locking hinge can be a cylindrical piece that has one or two detent pins located on the cylindrical piece, and a pin runs through the cylindrical piece and engages the legs, wherein the locking step pivots around the pin.

The steps can be shaped such that the user's feet cannot slide off the end of the rungs. The rungs and steps can be corrugated, knurled, dimpled, coated with skid-resistant material, or otherwise treated to minimize slipping. When the embodied space saving ladder is composed of wood, the wood can also be treated to minimize slipping, but not with any opaque covering, except for identification or warning labels, which are only placed on the side rails.

The steps that are not locking steps can be pivoting steps. The pivoting steps can be connected to the two legs by pivoting hinges. The pivoting hinges can be any type of hinge that can move the pivoting steps from its open load bearing orientation (perpendicular to the legs) to its closed orientation (disposed within the legs). In embodiments, the pivoting hinge can be a pin that runs through the pivoting step and engages the legs, wherein the pivoting step pivots around the pin.

The pins used herein for both the pivoting hinges and the locking hinges can be plunger pins. Plunger pins are used in applications with limited space as positioners, loading pins, alignment pins, and hinging devices. These hand retractable pins can be used as a fast and convenient way to adjust or remove accessories on equipment.

Figure 1B:
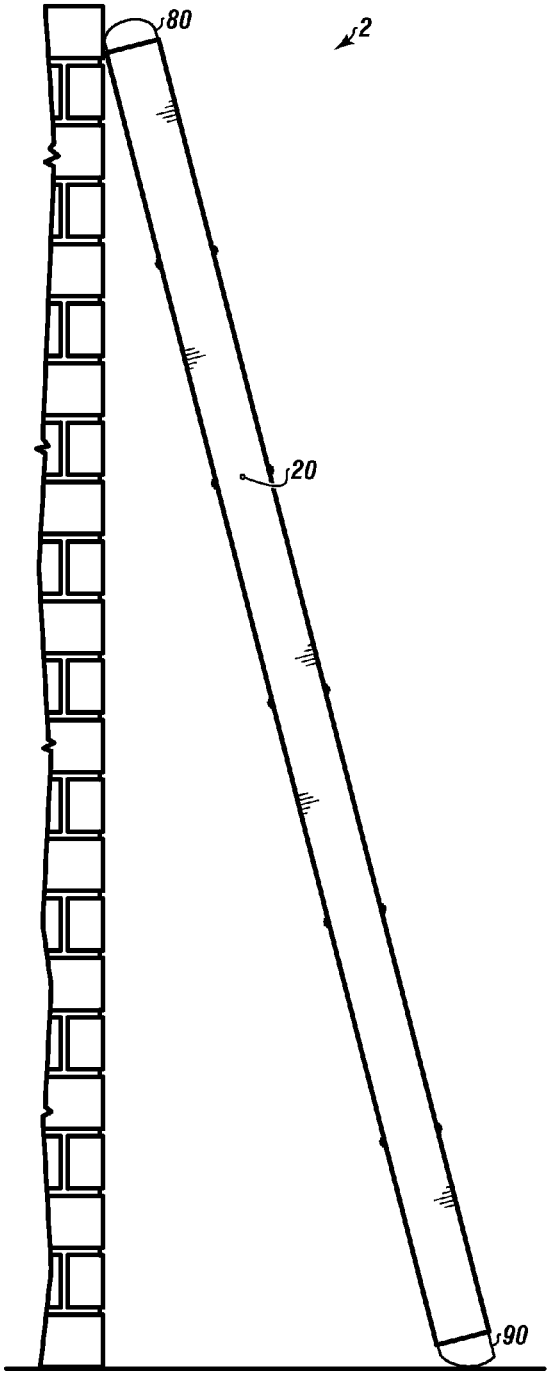
FIG. 1B is a side view of the space saving ladder according to one or more embodiments.

Turning now to the Figures, FIG. 1A is a front view of the space saving ladder. FIG. 1B is a side view of the space saving ladder.

Referring to FIGS. 1A and 1B, the space saving ladder 2 can include ladder top inserts 80 and ladder foot inserts 90. The ladder can also include a detent receptor 20.

Figures 2A, 2B, 2C:
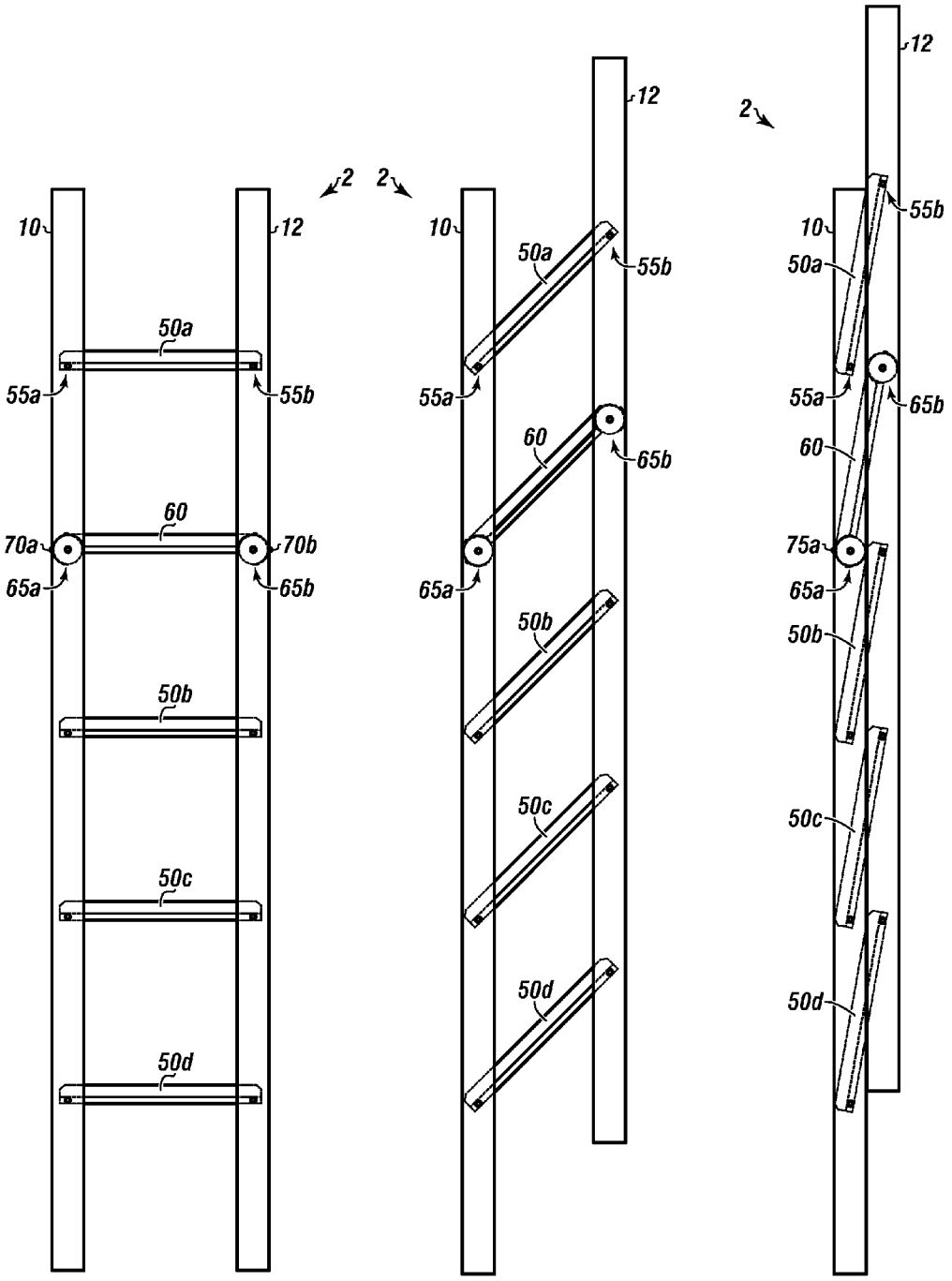
FIG. 2A depicts a front view of the space saving ladder in an open load bearing orientation according to one or more embodiments.
FIG. 2B depicts a front view of the space saving ladder in a position between the open load bearing orientation and a closed orientation according to one or more embodiments.
FIG. 2C depicts a front view of the space saving ladder in the closed orientation according to one or more embodiments.

FIG. 2A depicts a front view of the space saving ladder in the open load bearing orientation.

When the space saving ladder 2 is in the open load bearing orientation, the legs 10 and 12 can be vertical and parallel to one another. In embodiments, the legs can be connected by four pivoting steps 50*a*-50*d* and one locking step 60. The space saving ladder can include one or more locking steps and one or more pivoting steps.

Each pivoting step and locking step can be perpendicular to the legs and parallel to the ground. Each pivoting step can be connected to each leg by a pivoting hinge. Pivoting step 50*a* can be connected to leg 10 by pivoting hinge 55*a* and to leg 12 by pivoting hinge 55*b*. The locking step 60 can be connected to leg 10 by locking hinge 65*a* and to leg 12 by locking hinge 65*b*. Each locking hinge 65*a* and 65*b* can have a first detent pin 70*a* and 70*b*, respectively.

FIG. 2B depicts a front view of the space saving ladder in a position between the open load bearing orientation and the closed orientation.

The space saving ladder 2 is shown with two legs 10 and 12.

When the detent pin is released, the second leg 12 can be moved upward as each pivoting step 50*a*-50*d* and the locking step 60 hinge with the movement. Alternatively, the first leg 10 can be moved upward as each pivoting step and the locking step hinge with the movement.

Pivoting hinges 55*a* and 55*b* are shown connected to pivoting step 50*a*. Locking hinges 65*a* and 65*b* are shown connected to the locking step 60.

FIG. 2C depicts a front view of the space saving ladder in the closed orientation.

When the space saving ladder 2 is in the closed orientation, leg 12 can be adjacent to leg 10. Each pivoting step 50*a*-50*d* and the locking step 60 have moved in a hinged manner so that each step is enclosed in the chamber created by the two leg channels. Pivoting hinges 55*a* and 55*b* are shown connected to pivoting step 50*a*. Locking hinges 65*a* and 65*b* are shown connected to the locking step 60.

In some embodiments, the pivoting steps and locking steps can be disposed at least sixty percent in one of the two leg channels. The two leg channels can also be flush with one another.

When a second detent pin 75*a* is engaged into the detent receptor, the space saving ladder 2 can be "locked" in the closed orientation, thereby ensuring that the space saving ladder 2 remains closed when not in use.

Figure 3A:
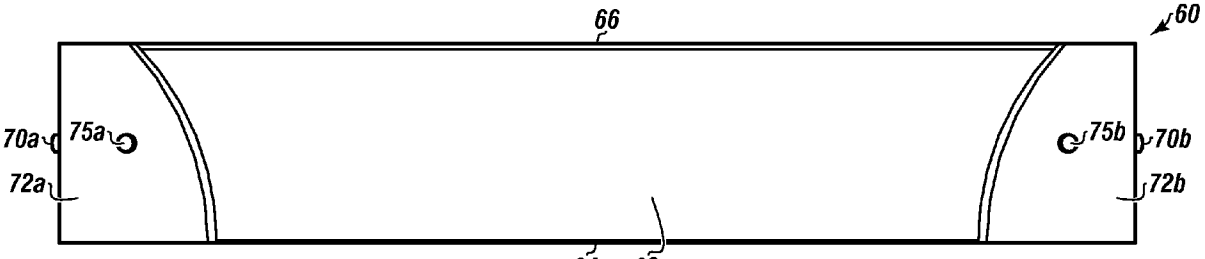
FIG. 3A depicts a top view of a locking step according to one or more embodiments.
Figure 3B:
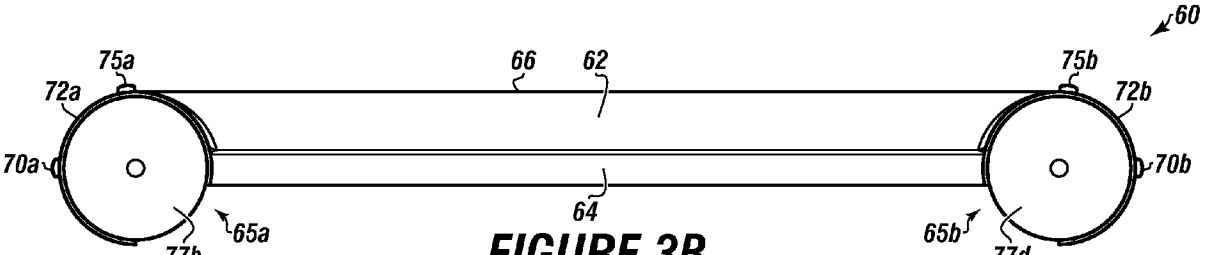
FIG. 3B depicts a side view of a locking step according to one or more embodiments.

FIG. 3A depicts a top view of a locking step. FIG. 3B depicts a side view of a locking step.

Referring to FIGS. 3A and 3B, each locking step 60 can have a locking top step panel 62, a locking front panel 64, and a locking back panel 66. The locking top step panel 62 can connect the locking front panel 64 and the locking back panel 66. The locking back panel 66 can be taller than the locking front panel 64.

Each locking hinge 65*a* and 65*b* can have a semicircular hollow body 72*a* and 72*b* disposed on each end of the locking step 60. In embodiments the semicircular hollow bodies can be connected by welding. Each semicircular hollow body 72*a* and 72*b* can have a first detent pin 70*a* and 70*b* respectively, for locking the space saving ladder in the open load bearing orientation. In embodiments, each semicircular hollow body can have a second detent pin 75*a* and 75*b* for locking the space saving ladder in the closed orientation. Each semicircular hollow body is shown with a flat panel 77*b* and 77*d*.

Figure 3C:
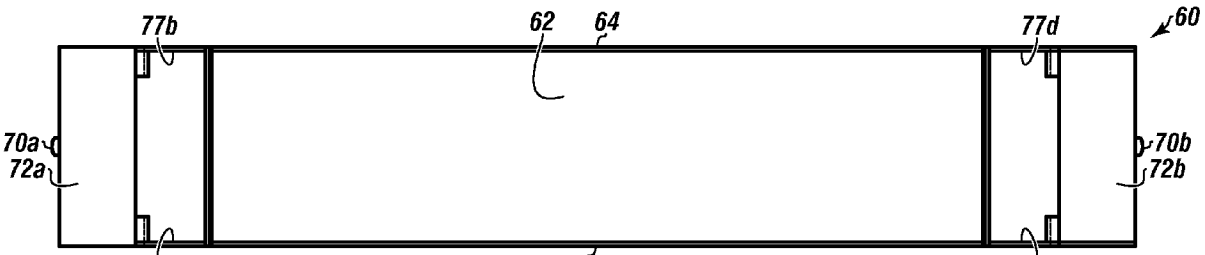
FIG. 3C depicts a bottom view of a locking step according to one or more embodiments.

FIG. 3C depicts a bottom view of a locking step. The locking step 60 can have a locking top step panel 62, a locking front panel 64, and a locking back panel 66. The first detent pins 70*a* and 70*b* are shown on each of semicircular hollow body 72*a* and 72*b*.

Each semicircular hollow body 72*a* and 72*b* can comprise two flat panels 77*a*-77*d*. A flat panel can be disposed on each end of the semicircular hollow body. Each flat panel can include a connection means, such as cylindrical projection extending towards each other. The rods can secure through both connection means to each of the legs.

Figure 3D:
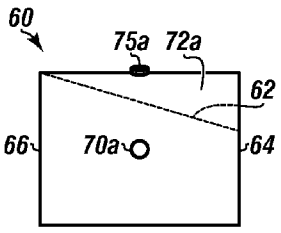
FIG. 3D depicts an end view of a locking step according to one or more embodiments.

FIG. 3D depicts an end view of a locking step. The locking step 60 can have a semicircular hollow body 72*a* disposed on an end of the locking top step panel 62. The locking top step panel 62 can be connected to the semicircular hollow body 72*a* and connected to the locking front panel 64 and the locking back panel 66 so that the locking top step panel 62 is parallel to the ground when the space saving ladder is leaning against a structure.

The first detent pin 70*a* and the second detent pin 75*a* are shown on the semicircular hollow body 72*a*.

FIG. 4A depicts an exploded view of the locking hinges. FIG. 4B depicts a completed view of the locking hinges.

Referring to FIGS. 4A and 4B, each locking hinge 65*a* and 65*b* can have a semicircular hollow body 72*a* and 72*b* disposed on each end of the locking step connected to the locking top step panel 62, a locking front panel 64, and a locking back panel 66.

Each semicircular hollow body can have a first detent pin 70*a* and 70*b* located on the semicircular hollow body. Each semicircular hollow body can have a flat panel on each end. Each flat panel can have a connection means 78*a*-78*d*, such as cylindrical projections extending towards each other. Rods 67*a* and 67*b* can secure through both connection means to each of the legs 10 and 12. Washers 68*a*-68*d* can be used as a separator between the legs and the locking step. The washers can be composed of polyamide (nylon).

Each semicircular hollow body can further comprise a second detent pin 75*a* and 75*b*. When the second detent pin is engaged into the detent receptor, the space saving ladder can be "locked" in the closed orientation, thereby ensuring that space saving ladder stays closed when not in use. Other locking mechanisms for the closed orientation are contemplated, such as a latch that connects the holds the legs together.

In the open load orientation, the first detent pin can align with and insert into the detent receptor located in the leg. When the first detent pin is engaged into the detent receptor, the space saving ladder can be "locked" in the open load bearing orientation, thereby providing stability to the embodied space saving ladder and allowing a load to be placed on the step. As discussed earlier, the embodied space saving ladder can include more than one locking step. If one or more locking step is used, a detent receptor is needed for each locking step. If one locking step is used, the locking step can be located near the center of the space saving ladder to provide the most stability and ease of access. If more than one locking step is used, the locking steps can be staggered from one another or orientated so that the most stability is provided.

In embodiments, the locking step can be located in a position that is easy to reach by a user.

Figure 5A:
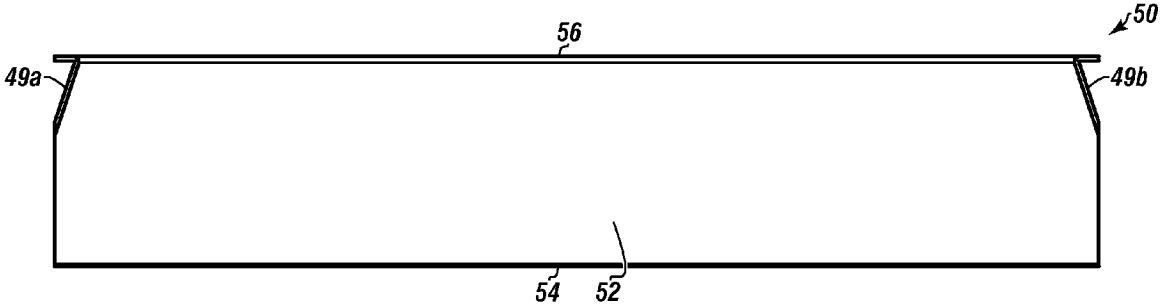
FIG. 5A depicts a top view of a pivoting step according to one or more embodiments.
Figure 5B:
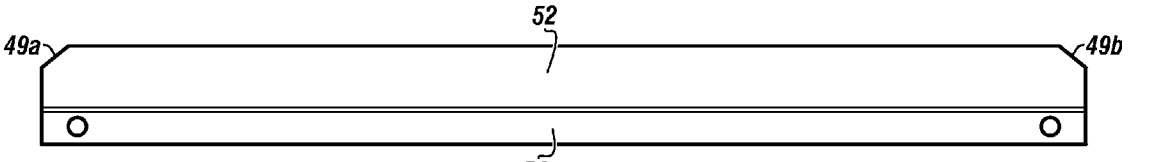
FIG. 5B depicts a side view of a pivoting step according to one or more embodiments.

FIG. 5A depicts a top view of a pivoting step. FIG. 5B depicts a side view of a pivoting step.

Referring to FIGS. 5A and 5B, each pivoting step 50 can have a pivoting top step panel 52, a pivoting front panel 54, and a pivoting back panel 56. The pivoting top step panel 52 can connect the pivoting front panel 54 and the pivoting back panel 56. The pivoting back panel 56 can be taller than the pivoting front panel 54.

Each pivoting step can have cut outs 49*a* and 49*b* located on the pivoting top step panel 52 on ends closest to the leg channels. The cut outs can allow the pivoting step to pivot into the leg channels without contacting the leg channels.

Figure 5C:
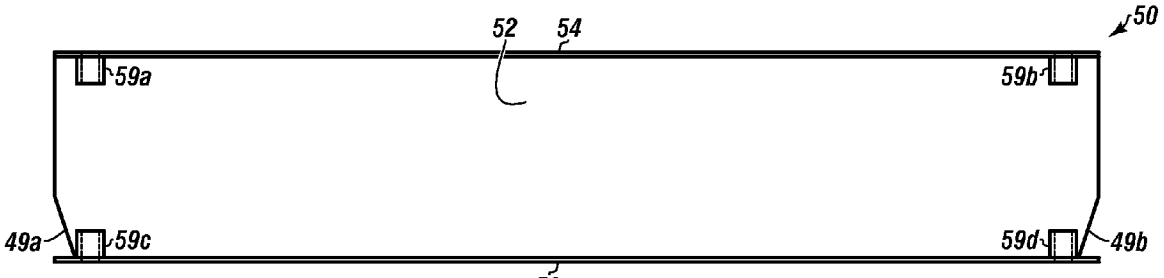
FIG. 5C depicts a bottom view of a pivoting step according to one or more embodiments.

FIG. 5C depicts a bottom view of a pivoting step. The pivoting step 50 can have a pivoting top step panel 52, a pivoting front panel 54, and a pivoting back panel 56. The cut outs 49*a* and 49*b* can be located on the pivoting top step panel 52 on ends closest to the leg channels. Threaded caps 59*a*-59*d* are also shown.

Figure 5D:
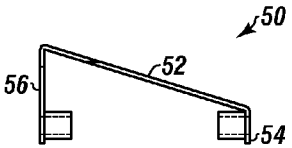
FIG. 5D depicts an end view of a pivoting step according to one or more embodiments.

FIG. 5D depicts an end view of a pivoting step. The pivoting step 50 is shown with the pivoting top step panel 52 as it slopes and connects the pivoting front panel 54 with the pivoting back panel 56.

FIG. 6A depicts an exploded view of the pivoting hinges. FIG. 6B depicts a completed view of the pivoting hinges.

Referring to FIGS. 6A and 6B, the pivoting top step panel 52, the pivoting front panel 54, and the pivoting back panel 56 are shown. The pivoting top step panel 52 can connect the pivoting front panel 54 and the pivoting back panel 56.

Each pivoting hinge 55*a* and 55*b* can have a rod 57*a* and 57*b* respectively. The rods can penetrate through the pivoting hinge and through two sides of each leg. The rods can be totally or partially threaded. Washers 58*a*-58*d* can be used as a separator between the legs 10 and 12 and the pivoting step. Each washer can be composed of polyamide (nylon).

The rods 57*a* can connect between the pivoting top step panel 52 and the pivoting back panel 56 through the threaded caps, which are shown in FIG. 5C.

The pivoting steps can be connected with a pivoting hinge, which can be any type of hinge that can move the pivoting step from its open load bearing orientation (perpendicular to the legs) to its closed orientation (disposed within the legs); however, the pivoting hinge described herein has provided the best results for the embodied space saving ladders.

Feet where the space saving ladder is stabilized on the ground are well-known in the art. Any of the known ladder feet can be used with the space saving ladders embodied herein.

Figure 7A:
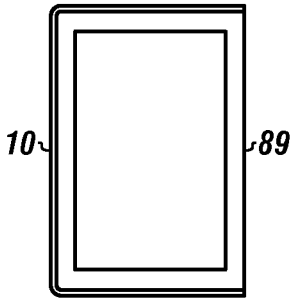
FIG. 7A depicts an end view of a bottom side rectangular box disposed in a leg.

FIG. 7A depicts an end view of a bottom side rectangular box disposed in a leg. The bottom side rectangular box 89 can be constructed to fit within the channel of the leg 10. Custom made ladder feet can then be inserted into the bottom side rectangular box and swapped in and out of the space saving ladder depending upon the use. The feet can be composed of wood, aluminum, fiberglass, steel, or rubber. Alternatively, the feet can be constructed as an integrated part of the legs themselves, also known as a one-piece construction.

The feet can be pivoting feet so that the feet are flat on the ground regardless of the angle of the space saving ladder against a structure. The feet can be rounded or semi-circular so that the feet make strong contact points with the ground regardless of the angle of the space saving ladder against a structure. Either the pivoting feet or the rounded feet can have a ribbed or channeled surface in order to provide for less slippage between the ground and the space saving ladder.

Wherein the current art of ladder feet are directed to being placed right at the base of the space saving ladder, the ladder legs can be widened to the outside of the ladder leg in order to provide more stability in the embodiments.

The top of the space saving ladder can be designed as to not scratch or mar the structure when the space saving ladder is in use.

Figure 7B:
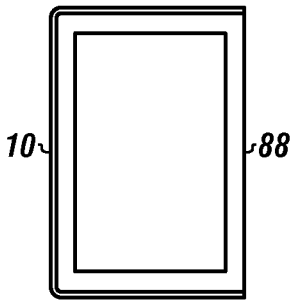
FIG. 7B depicts an end view of the top side rectangular box disposed in a leg.

FIG. 7B is an end view of the top side rectangular box disposed in a leg. A top side rectangular box 88 can be constructed to fit within the channel of the leg 10. Different types of molded tops can be inserted into the top side rectangular box to ensure that the space saving ladder is stable and non-slipping against the structure and that the structure is not scratched or marred. Alternatively, a top can be constructed into the legs as a one-piece structure. Also, the top of the legs themselves can be slightly angled so that the top of the space saving ladder is flush with the structure when the space saving ladder leans against the structure.

Depending on the spacing between the steps or rungs in the embodied space saving ladders, the top of the legs can be constructed as slightly longer in order to allow for proper closing.

The embodied space saving ladders can be constructed of wood, aluminum, fiberglass, alloys, or steel. Wood is the most affordable and is good for indoor use. Aluminum ladders weigh the least, are durable enough to withstand most use, but the legs can bend and the steps or rungs can sag. Fiberglass is nearly as light as aluminum, and far more durable in everyday use. In addition, fiberglass ladders are safest, not only near electrical currents but also in wet and sloppy conditions. Steel ladders are the heaviest, but the most durable of the materials The embodied space saving ladders can sustain at least four times the maximum intended load, unless the embodied space saving ladder is composed of extra-heavy-duty type 1A metal or plastic ladders, wherein the embodied space saving ladders can sustain at least 3.3 times the maximum intended load. The ability of the embodied space saving ladders to sustain the noted loads is calculated by applying or transmitting the requisite load to the ladder in a downward vertical direction when the space saving ladder is placed at an angle of 75½ degrees from the horizontal.

When in the open load bearing orientation, the embodied ladder steps are parallel to the ground, level, and uniformly spaced. The steps of the embodied space saving ladders can be spaced no less than 10 inches (25 cm) apart and no more than 14 inches (36 cm) apart, as measured between center lines of the rungs, cleats and steps. When in the open load bearing orientation, the minimum clear distance between the legs for the embodied space saving ladders can be 11½ inches (29 cm). The minimum perpendicular clearance between fixed ladder rungs, cleats, and steps, and any obstruction behind the space saving ladder can be 7 inches (18 cm).

In the closed orientation, the width of the embodied space saving ladders can be no more than 20 percent of the width of the space saving ladder in the open load bearing orientation.

The minimum perpendicular clearance between the center line of fixed ladder rungs, cleats, and steps, and any obstruction on the climbing side of the space saving ladder can be 30 inches (76 cm). If an unavoidable obstruction is encountered, the minimum perpendicular clearance between the centerline of fixed ladder rungs, cleats, and steps, and the obstruction on the climbing side of the space saving ladder can be reduced to 24 inches (61 cm), provided that a deflection device is installed to guide employees around the obstruction. The embodied space saving ladders do not exceed 24 feet (7.3 m).

While these embodiments have been described with emphasis on the embodiments, it should be understood that within the scope of the appended claims, the embodiments might be practiced other than as specifically described herein.

What is claimed is:

1. A space saving ladder comprising:

a. a first leg and a second leg, parallel to each other, wherein each leg comprises a detent receptor;

b. a plurality of pivoting steps, wherein each pivoting step is connected to the first leg with a first pivoting hinge and is connected to the second leg by a second pivoting hinge, wherein the pivoting hinges allow the space saving ladder to move between an open load bearing orientation and a closed orientation; and c. at least one locking step, wherein the at least one locking step is connected to the first leg with a first locking hinge and is connected to the second leg by a second locking hinge, wherein the first locking hinge and the second locking hinge each comprise a first detent pin and a second detent pin; and wherein, in the open load bearing orientation, the first detent pin locks into the detent receptor; wherein, in the closed orientation, the second detent pin locks into the detent receptor; and wherein, in the closed orientation, the first leg and the second leg are adjacent to each other, and the pivoting steps and the locking steps are disposed completely within the leg.

2. The space saving ladder of claim 1, wherein each pivoting step further comprises a cut out located on an end closest to the leg, wherein the cut out allows the pivoting step to pivot into the leg without contacting the leg.

3. The space saving ladder of claim 1, wherein the first locking hinge and the second locking hinge each comprises a semicircular hollow body, wherein the first detent pin is located on the semicircular hollow body, and further wherein the first locking hinge and the second locking a rod, wherein the rod is disposed through the semicircular hollow body connecting to the leg.

4. The space saving ladder of claim 3, wherein the first detent pin is a plunger pin.

5. The space saving ladder of claim 1, wherein the first leg and the second leg are comprised of wood, aluminum, steel, metal alloys, or plastic.

6. The space saving ladder of claim 1, further comprising a bottom side rectangular box, wherein the bottom side rectangular box is inserted flush into the leg on a bottom end.

7. The space saving ladder of claim 6, further comprising a bottom side molded foot, wherein the bottom side molded foot is inserted flush in the bottom side rectangular box.

8. The space saving ladder of claim 1, further comprises a washer disposed between each pivoting step and the leg.

9. The space saving ladder of claim 1, wherein each pivoting step comprises a pivoting top step panel between a pivoting front panel and a pivoting back panel.

10. The space saving ladder of claim 9, wherein the pivoting back panel is taller than the pivoting front panel.

11. The space saving ladder of claim 1, further comprising a top side rectangular box, wherein the top side rectangular box is inserted flush into the leg on a top end.

12. The space saving ladder of claim 11, further comprising a molded top, wherein the molded top is inserted flush in the top side rectangular box.

13. The space saving ladder of claim 1, wherein each locking step comprises a locking top step panel between a locking front panel and a locking back panel.

14. The space saving ladder of claim 13, wherein the locking back panel is taller than the locking front panel.

15. The space saving ladder of claim 1, wherein in the closed orientation, the first leg and the second leg are flush to each other.

16. The space saving ladder of claim 1, wherein in the closed orientation, the pivoting steps and locking steps are disposed at least sixty percent in one of the legs.

17. The space saving ladder of claim 3, wherein each semicircular hollow body comprises two flat panels, wherein each flat panel is disposed on each end of the semicircular hollow body, and wherein each flat panel further comprises a connection means for engaging a rod and the leg.

* * * * *